United States Patent [19]

Yurko

[11] 4,064,062

[45] * Dec. 20, 1977

[54] STABILIZED ACTIVATED PERCOMPOUND BLEACHING COMPOSITIONS AND METHODS FOR MANUFACTURE THEREOF

[75] Inventor: Joseph A. Yurko, Bayonne, N.J.

[73] Assignee: Colgate-Palmolive, New York, N.Y.

[ * ] Notice: The portion of the term of this patent subsequent to Oct. 25, 1994, has been disclaimed.

[21] Appl. No.: 641,018

[22] Filed: Dec. 15, 1975

[51] Int. Cl.[2] ..... C11D 7/54

[52] U.S. Cl. ..... 252/99; 252/95; 252/97; 252/100; 252/186; 8/111; 427/242

[58] Field of Search ..... 252/99, 94, 100, 97, 252/95, 186; 8/111; 427/242

[56] References Cited

U.S. PATENT DOCUMENTS 3,816,319 6/1974 Sarot et al. ..... 252/99 X

FOREIGN PATENT DOCUMENTS 813,561 4/1974 Belgium ..... 252/99

*Primary Examiner*—Mayer Weinblatt

[57] ABSTRACT

A stabilized activated percompound bleaching composition comprises a mechanical mixture of a bleaching percompound, such as sodium perborate tetrahydrate, an activator for such percompound, such as 2-[bis(2-hydroxyethyl)amino]-4,6-dichloro-s-triazine, a molecular sieve zeolite, such as an anhydrous type 4A synthetic molecular sieve zeolite and a higher fatty acid, such as myristic acid. The bleaching composition is made by mechanically mixing the various powdered constituents, preferably by tumbling at about room temperature, and the product resulting is more stable on storage and more effective as a bleach in removing various stains from laundry than are similar products which do not contain the higher fatty acid.

Also within the invention is a stabilized activated percompound bleaching detergent composition, including the described bleaching composition plus a synthetic organic detergent, such as sodium higher linear alkylbenzene sulfonate. The method of manufacture of such bleaching detergent and uses of the bleaching composition and the bleaching detergent compositions are also described.

18 Claims, No Drawings

STABILIZED ACTIVATED PERCOMPOUND BLEACHING COMPOSITIONS AND METHODS FOR MANUFACTURE THEREOF

This invention relates to a stabilized activated percompound bleaching composition. More particularly, it relates to such compositions and bleaching detergent compositions in which a percompound and an activator for it are stabilized by being mechanically mixed in a particulate state with molecular sieve zeolite and higher fatty acid, both of which are also in powder form.

Manufacturers of powdered bleaches and powdered bleaching detergents have long recognized that bleaching materials, such as percompounds, tend to lose bleaching activity on storage. Part of such loss is attributable to atmospheric moisture dampening the product and promoting reactions of the percompound and other composition constituents which permaturely release active oxygen from the compound. In the presence of activator(s) for the percompound, functioning to promote faster release of active oxygen from such compound at lower temperatures (often to release all the active oxygen of a percompound, such as sodium perborate, it is otherwise necessary to raise the temperature of an aqueous medium containing such unactivated compound to near the boiling point) the problem of maintaining a stable composition during storage is aggravated.

To prevent premature decomposition of percompounds and activators for them in bleaching products during storage, percompounds and activators have been coated with protective coating agents by melting such agents and spraying them onto the surfaces of the percompound and activator particles, as in German Offenlegungsschrift 2,138,584. Fatty acids, such as lauric acid, have been employed as carriers for powdered activated bleaches, as is disclosed in German Offenlegungsschrift 2,220,296. German Offenlegungsschrift 2,203,885 teaches that peroxygen compounds, such as sodium perborate, may be stabilized at least in part against decomposition by being coated with a higher fatty acid. Canadian Pat. No. 678,942 discloses covering an activator for a percompound with stearic acid or a mixture of stearic and palmitic acids. Various references teach the use of a film-forming material in solution, sprayed onto percompound and activator particles to produce protective coatings. Finally, German Offenlegungsschrift 2,412,839, which describes the use of certain molecular sieve zeolites in detergent compositions, teaches that these may contain sodium perborate and water insoluble stabilizers for it but higher fatty acids are not mentioned.

It is seen from the preceding brief review of some of relevant prior art that both molecular sieve zeolites and higher fatty acids have been suggested for use in activated percompound bleaching compositions. However, in such compositions they were not employed together in the same manner as in the present invention, the compositions were not made by the same method and the improved results of this invention, which represent a significant advance in the art, were not achieved.

In accordance with the present invention a stabilized activated percompound bleaching composition comprises a mechanical mixture of a bleaching percompound, an activator for such percompound which, in aqueous bleaching solution, activates the percompound to promote bleaching by it, a molecular sieve zeolite and a higher fatty acid. In a preferred embodiment of the invention, in a bleach or bleaching detergent composition, sodium perborate tetrahydrate, activated by 2-[bis(2-hydroxyethyl)amino]-4,6-dichloro-s-triazine, is stabilized by being mechanically mixed at room temperature with powdered myristic acid and very finely divided, usually anhydrous type 4A molecular sieve zeolite. The invention encompasses bleaching compositions, bleaching detergent compositions, methods for the manufacture thereof and methods for the use thereof.

The invented method of making bleaching compositions and bleaching detergent compositions containing stabilized mixtures of percompound and activator is easily practiced, requires no heating of the higher fatty acid (therefore being energy conserving) and is capable of being effected in simple mixing equipment (no spraying needed). The product resulting is of excellent shelf stability, comparable to or superior to similar products in which higher fatty acid is sprayed onto the surfaces of other particulate components of the compositions. Bleaching and washing with the products made is better than with comparable products in which the percompound and activators are not protected and is equal to or better than that with similar compositions in which higher fatty acid is sprayed onto particles of other composition components.

The percompounds or peroxy compound bleaching materials are inorganic compounds, perferably salts, such as metal salts, more preferably alkali metal or alkaline earth metal salts and most preferably the sodium (and potassium) salts of inorganic peracids, of which sodium perborate and sodium percarbonate are nost preferable.

Sodium perborate is the most widely used of such compounds at present and at a concentration of one gram of sodium perborate per liter in water it yields about 100 parts per million of active oxygen. The perborate referred to is the tetrahydrate, $NaBO_2 \cdot H_2O_2 \cdot 3H_2O$, the most usual commercial form of sodium perborate and in this specification when sodium perborate is referred to the tetrahydrate is intended or an equivalent weight (on the basis of active oxygen released) of anhydrous perborate or other hydrate. While sodium perborate tetrahydrate is about 10% of active oxygen, the sodium percarbonate of commerce, $2Na_2CO_3 \cdot 3H_2O_2$, usually contains about 12 to 14% of active oxygen. Other percompounds which may be used in place of the mentioned perborate and percarbonate, such as sodium peroxypyrophosphate and sodium peroxysilicate, and other alkali metal perborates, percarbonates, peroxypyrophosphates and peroxysilicates, will normally be employed in weights sufficient to produce equivalent proportions of active oxygen when they are substituted for the mentioned perborate and/or percarbonate. When a perborate is employed the tetrahydrate is preferred but the monohydrate and other hydrated forms are also useful. Similarly, equivalent amounts of other oxygen-releasing percompounds and their hydrates may be used. Sodium peroxypyrophosphate and sodium peroxysilicate are also useful and other suitable peroxy materials or percompounds, especially salts, e.g., alkali metal salts, may also be employed, at least in part, under suitable conditions, such as sodium persulfate and sodium peroxide. In general the perferred percompounds to be activated are those which contain hydrogen peroxide within their structure and which are generally inorganic. However, these may sometimes be organic, such as, for example, urea peroxides. Inorganic percompounds are disclosed in U.S. Pat. No. 3,532,634 (Woods), the disclosure of which is incorporated herein by reference. As was previously mentioned with respect to peroxy type compounds the relative amounts or proportions of the peroxy materials employed will usually be such as are equivalent in active oxygen released to the taught amounts or proportions of the perborates. The percompounds used, perferably the perborate or percarbonate, will normally be in finely divided powdered form, preferably of particle sizes in the 37 to 250 micron diameter range, e.g., in the range of 44 to 149 microns, but sizes larger than 250 microns, sometimes up to 2 or 2.5 millimeters, may be employed. Because of their usual instabilities at high temperatures normally the percompounds and the activators for them will not be spray dried with other bleaching composition constituents prior to mixing with the higher fatty acid stabilizer but may be blended with such constituents or other powdered components, size reduced in mixture with these materials or otherwise combined with them at room temperature or temperatures at which the percompounds and activators are stable, e.g., 5° to 50° C. Of course, such mixing will be in the dry state, absent water or moisture, which otherwise could promote release of active oxygen from the percompound.

In an effort to facilitate bleaching with percompounds at temperatures lower than 80° C.. e.g., lower than 50° C., various activators have been suggested which regulate the release of active oxygen from the percompounds, usually by increasing the speed of release and promoting such release at lower temperatures. Among such compounds are certain triazine derivatives, such as 2-[bis(2-hydroxyethyl)amino]-4,6-dichloro-s-triazine, hereafter coded BHADT, and 2,4-dimethoxy-6-chloro-s-triazine, hereafter called DCT. Such activators may be employed with other known activators, such as diacetyl dimethyl glyoxime, hereinafter referred to as DDG and tetraacetyl glycoluril, hereinafter referred to as TAG. The latter two activators, while useful to improve the release of active oxygen from percompounds, especially sodium perborate, are not usually sufficiently effective to speed the release of active oxygen from the percompounds at a satisfactory rate in cold or warm water (10° C. to 50° C.) and do not produce active oxygen to the extent that it is released from sodium perborate at the boil, as in the European methods of bleaching and washing.

In the present compositions the most preferred type of activator for the percompounds is one of the triazine or triazine derivative type. Such materials are usually capable of forming hydroperoxides and are preferably selected from the group consisting of 2-[di-(2-hydroxy-lower alkyl)amino]-4,6-dihalo-s-triazines and 2,4-di-lower alkoxy-6-halo-s-triazines and mixtures thereof. The hydroperoxide-forming triazine compounds of the 2-[di(2-hydroxy-lower alkyl)amino]-4,6-dihalo-s-triazine structure will normally be those wherein the lower alkyls (actually alkylenes) are of 1 to 5 carbon atoms, perferably 1 to 3 carbon atoms and the halogens are either chlorine atoms or bromine atoms or mixtures thereof, preferably all being chlorine. The alkyls of the hydroxyalkyl groups may be different but normally are the same and the halogens may be different but normally will also be the same. The 2,4-di-lower alkoxy-6-halo-s-triazine compounds will usually have the lower alkoxy groups of 1 to 4 carbon atoms, preferably of 1 to 2 carbon atoms and the halogens will normally be chlorine or bromine or mixtures thereof, preferably all chlorine. The alkoxies will usually preferably be methyl but sometimes ethyl may be preferred. Generally, the alkoxies and the halogens will be the same but they may be different, too, within the descriptions given. Mixtures of the triazine derivatives of the type resembling BHADT may be made with those of the type resembling DCT and mixtures within each type group may also be made.

While triazine activators are preferred, it also will be possible to blend with them other types of activators, preferably acyl activators, which have been found to have a desirable bleach-controlling effect on percompounds in the presence of triazine activators, slowing the bleaching action somewhat to prevent overbleaching of colored fabrics. The desirable utilization of combinations of the percompounds, triazine and acyl activators, sometimes in the presence of detergents, is described in U.S. patent application Ser. No. 487,889 of Frederick W. Gray, entitled Activated Peroxy Bleach Composition, filed July 12, 1974, herein incorporated by reference.

The activators of the acyl activator class are preferably compounds selected from the group consisting of di-lower alkanoyl di-lower alkylglyoximes and tetra-lower alkanoyl glycolurils and mixtures thereof. With respect to the di-lower alkanoyl di-lower alkyl glyoximes, the alkanoyls are usually of 2 to 5 carbon atoms, with 2 to 3 carbon atoms being preferred, and normally will be the same, although they may be independently selected. Similarly, the alkyl groups, including the alkyls of hydroxyalkyl and alkoxy, may be independently selected but will normally be the same and will generally be of 1 to 4 carbon atoms, with 1 to 2 carbon atoms being preferred. The tetra-lower alkanoyl glycolurils also have alkanoyl substituents of 2 to 5 carbon atoms, with those of 2 to 3 carbon atoms being preferred and with it generally being preferred to have all four alkanoyl groups the same, although they may also be independently selected. Mixtures of the mentioned compounds of the glyoxime and glycoluril derivatives types may be employed, as may be mixtures of individual compounds of each type. Although it may be preferred to utilize a mixture of triazine and acyl type activators, this invention is very useful and practicable when only a triazine type activator is present.

Although the preferred triazine and acyl activators are described above, in a broader sense the present invention also relates to improving the stability of percompounds and peroxy bleach compounds in bleaches and bleaching detergents by having present with them other hydroperoxide-forming triazine activators or mixtures of such activators or mixtures of hydroperoxide-forming-triazine activator(s) and peracid-generating acyl activator(s), a molecular sieve zeolite and a higher fatty acid, mixed together as described herein. The words "hydroperoxide-forming" and "peracid-generating" are intended to emcompass compounds functioning like those previously described as examples of such classes. For example, among such other acyl activators, which preferably produce percarboxylic acids (or salts), e.g., peracetic acid, are: benzioc anhydride; tetraacetylethylenediamine; N-acetyldimethyl-hydantoin; N-acetyl-1-phenylhydantoin; ESPC [ethyl sulfophenyl carbonate or salt thereof (the sodium salt is preferred)]; TAED; TACA; CSA; SABS; chlorobenzoic anhydride; p-acetoxybenzoic acid; and various other such compounds of the anhydride ester, acyl halide, acyl cyanurate and acyl amide classes, such as are described by Gilbert in a series of articles appearing in Detergent Age, June 1967, pages 18–20; July 1967, pages 30–33; and August 1967, pages 26, 27 and 67; by Wood in U.S. Pat. No. 3,532,634; and by Gray in U.S. Pat. No. 3,637,339, all of which are hereby incorporated herein by reference. The Gilbert references include descriptions of the abbreviated names of some of the activators. Also incorporated by reference is the disclosure of the Loffelman et al. U.S. Pat. No. 3,775,333 for its disclosure of N-acyl azoline acyl activators and the use of mixtures of such activators. With respect to both the hydroperoxide-forming triazine activators and the acyl activators, which latter are preferably materials which yield peracetic acid for peroxy compound activation, instead of aliphatic substituents such as the alkyl and alkanoyl groups it may sometimes be desirable to employ aromatic substitution. Thus, benzoyl radicals may be the acyl radicals of the activators described above and phenyl groups may substitute for the alkyls. Generally, however, it is preferred to utilize aliphatic substitution.

With respect to the triazine compounds, these are of the formula

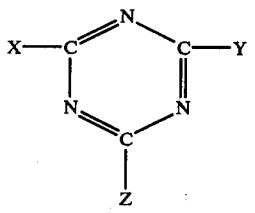

wherein X is halogen (Cl or Br); Z is a solubilizing group (-N-di-lower alkanol; N-lower alkanol-lower alkyl; -O-lower alkyl; -lower alkanol; N-dilower alkyl; N-lower alkyl, lower alkanol and combinations thereof); and Y is either X or Z or a mixture thereof. Although the alkyls are preferably of 1 to 4 carbon atoms they may be of up to 12 carbons, too and aromatic substitutents may be present in some cases. In addition to the compounds previously described as representative of the "triazine" activators there may also be used those of the formula given wherein: 1) X is chlorine, Y is chlorine, and Z is methoxy; 2) X is chlorine Y is chlorine and Z is $—NHCH_3$; 3) X is chlorine, Y is chlorine and Z is $—N(C_2H_5)_2$; and 4) X is chlorine; Y is $—NHCH_3$ and Z is $—NHCH_3$. Instead of chlorine, bromine may be substituted. Such compounds are described in Swedish Patent Application No. 73 10 334–3 filed July 25, 1973 by Mitsubishi GAF Chemical Co., Inc. for A Method of Bleaching, claiming priority of Japanese Application No. 75537, filed July 29, 1972, both hereby incorporated by reference.

The molecular sieves utilized in making the invented bleaching composition are water insoluble crystalline aluminosilicate zeolites of natural or synthetic origin which are characterized by having a network of uniformly sized pores in the range of about 3 to 10 Angstroms, preferably about 4 A (nominal), which size is uniquely determined by the unit structure of the zeolite crystal. Of course, zeolites containing two or more such networks of different size pores can also be employed.

The molecular sieve zeolite should also be a univalent cation-exchanging zeolite, i.e., it should be an aluminosilicate containing a univalent cation such as sodium, potassium or lithium, when practicable or of ammonium or hydrogen. Preferably, the univalent cation associated with the zeolite molecular sieve is an alkali metal cation, especially sodium or potassium, most preferably sodium.

Crystalline types of zeolites utilizable as molecular sieves in the invention, at least in part, include zeolites of the following crystal structure groups: A, X, Y, L, mordenite and erionite. Mixtures of such molecular sieve zeolites can also be useful, especially when type A zeolite, e.g., type 4A, is present. These preferred crystalline types of zeolites are well known in the art and are more particularly described in the text, *Zeolite Molecular Sieves,* by Donald W. Breck, published in 1974 by John Wiley & Sons. Typical commercially available zeolites of the aforementioned structural types are listed in Table 9.6 at pages 747–749 of the Breck text, while table is incorporated herein by reference.

Preferably the molecular sieve zeolite used in the invention is a synthetic molecular sieve zeolite. It is also preferably that it be of type A crystalline structure, more particularly described at page 133 of the aforementioned text. Especially good results are generally obtained in accordance with the invention when a type 4A molecular sieve zeolite is employed, wherein the univalent cation of the zeolite is sodium and the pore size of the zeolite is about 4 Angstroms. The especially preferred zeolite molecular sieves are described in U.S. Pat. No. 2,882,243 which refers to them as Zeolite A.

Molecular sieve zeolites can be prepared in either a dehydrated or calcined form, the latter form containing from less than about 1.5% to about 3% of moisture, or in a hydrated or water loaded form which contains additional adsorbed water in an amount up to about 30 to 36% of the zeolite total weight, depending on the type of zeolite used. Sometimes water-containing hydrated or partially hydrated forms of molecular sieve zeolites are employed in bleaches and detergent compositions and these usually have a water content of 20 to 28.5%, e.g., 20 to 22%. However, in the present invention the anhydrous zeolites, usually of 0.5 to 3% moisture content, are preferred because thay have a greater stabilizing effect on the percompound and activator mixture.

The manufacture of both anhydrous and hydrated zeolite crystals is well known in the art. For example, in the preparation of Zeolite A, referred to above, the partially hydrated or hydrated zeolite crystals that are formed in the crystallization medium (such as a hydrous amorphous sodium aluminosilicate gel) are dehydrated at high temperature (calcining to 3% or less water content) as is normally practiced in preparing such crystals for use as catalysts, e.g., cracking catalysts. The hydrated or partially hydrated form can be recovered by filtering off the crystals from the crystallization medium and drying them in air at ambient temperature to such an extent that the water content thereof is as desired.

Usually the molecular sieve zeolite should be in finely divided condition, such as crystals (amorphous or poorly crystalline particles may also fine some use) having mean particle diameters in the range of about 0.5 to about 12 microns, preferably 5 to 9 microns and especially about 5.9 to 8.3 microns, e.g., 6.4 to 8.3 microns.

The higher fatty acids employed are those of 12 to 16 carbon atoms and are saturated. A small proportion, e.g., up to 20%, of higher fatty acids of 10 and 18 carbon atoms and/or unsaturated fatty acids may be employed in some instances, providing that at least 80% of the higher fatty acids used are saturated and of a carbon atom content in the range of 12 to 16, most preferably 14. For best results myristic acid should be used. In some circumstances other water insoluble fatty or plastic materials can be utilized with the higher fatty acids but such materials should be water dispersible or emulsifiable (although not water soluble) so that during the washing process they will set free percompound and activator and allow these to react to release active oxygen. Also, by utilizing emulsifiable or water dispersible materials depositions of stabilizing agent on the laundry may be prevented or minimized. Again, the percentage of such adjuvant stablilizers should be kept low, at a maximum of 20% and in the most preferable embodiments of the invention only the higher fatty acid (myristic acid) stabilizer will be employed. As examples of stabilizing adjuvants that may be used with myristic acid there may be named paraffinic materials of 12 to 18 carbon atoms, higher fatty alcohols of similar carbon atom contents, monoglycerides, diglycerides and triglycerides of higher fatty acids, of similar waxy properties, plastic points, etc. and other polymeric coating agents known to the art, e.g., polyethylenes, polyethylene oxide-propylene oxide condensation products, polyoxyethanols. Mixtures of the various stabilizers described may be employed to adjust the properties thereof to those which are the most desirable for the particular application. For example, a lower molecular weight higher fatty acid may be blended with one of higher molecular weight to make the mixture of the right degree of plasticity to satisfactorily mix with and stabilize the percompound-activator mixture during milling or other blending operation.

The bleaching compositions of this invention may be used directly for bleaching purposes or, as is often preferable, may be included in detergent compositions for bleaching, water softening and antimicrobial effects. Also, they may be utilized in fabric softening preparations, pre-soak compositions for treatment of laundry before washing, commercial bleaching compositions for bleaching raw fibers, stain removing products, bleaching scouring cleansers, denture cleansers and sterilizing or antimicrobial compositions. However, of these applications, it is preferable to utilize the activated peroxy compound bleaching compositions in detergent products.

When in addition to the percompound, activator(s), molecular sieve zeolite and higher fatty acid there is also present a synthetic organic detergent, a bleaching detergent composition is produced, which is useful in cleaning and whitening laundry, especially laundry containing normal hard to remove (by washing only) stains, such as tea, coffee, wine, dye, ink, chocolate and fruit juice stains. The detergent utilized, a synthetic surface active agent having detersive properties, normally referred to as a synthetic organic detergent, in this specification includes higher fatty acid soaps, which are in the class of anionic synthetic organic detergents. The anionic detergents will normally have from 8 to 26, preferably from 12 to 22 carbon atoms per molecule and usually will include an alkyl or aliphatic chain containing about 8 to 18 carbon atoms, preferably from 10 to 16 carbon atoms in a straight chain alkyl group. The most preferred of such detergents are the alkali metal higher alkylbenzene sulfonates, such as the sodium and potassium salts, in which the higher alkyl groups are of 10 to 18 carbon atoms, preferably 12 to 14 carbon atoms and preferably also are linear. Other such anionic detergents include the alpha-olefin sulfonates, paraffin sulfonates, ethoxylated alcohol sulfates, alkyl sulfates and sulfated higher alkyl phenyl polyoxyethylene ethanols, all preferably as alkali metal salts, such as the sodium salts. A list of such detergents is found in U.S. Pat. No. 3,637,339.

Nonionic detergent compounds may also be employed, often in admixture with an anionic detergent. Such compounds will normally be lower alkylene oxide condensation products, such as polyethylene oxides, which may sometimes have polypropylene oxide present but only to such an extent that the product is still water soluble. Preferred examples of such materials are the higher fatty alcohol-polyethylene oxide condensates wherein the higher fatty alcohol is of 10 to 18 carbon atoms, preferably 12 to 15 carbon atoms and the ethylene oxide portion thereof is a chain of 6 to 30 ethylene oxide units, preferably 7 to 15 ethylene oxide units and more preferably about 10 to 15 ethylene oxide units. Also useful are similar ethylene oxide condensates of phenols, such as nonyl phenol or isooctyl phenol but these are not preferred. Preferably, the nonionics are normally solid.

In addition to the anionic and nonionic detergent compounds, both of which are preferable constituents of detergent compositions containing the present activated bleaching compositions, especially in mixture, there may also be employed amphoteric and cationic detergents. The amphoteric detergents are those containing both anionic and cationic solubilizing groups and a hydrophobic organic group, which is advantageously a higher aliphatic radical containing about 10 to 20 carbon atoms. Examples of such products include the N-alkyl betaamino-lower alkanoic acids, the N,N-dilower alkylglycines, the fatty imidazolines and the betaines. The cationic detergents are usually those which contain 1 or 2 higher molecular weight substituents and 2 or 3 lower molecular weight substituents on a positively charged ammonium nucleus which also has a halide ion, preferably a chloride or bromide. The higher weight or long chain substituents are usually of 8 to 18 carbon atoms and preferably are lauryl, myristyl or stearyl, with stearyl being most preferred. The lower weight short chain substituents are preferably lower alkyl, such as alkyl of 1 to 4 carbon atoms, e.g., methyl. Exemplary of the cationic detergents are distearyl dimethyl ammonium chloride, cetyl trimethyl ammonium bromide, benzyl dimethylstearyl ammonium chloride and dimethyl propylmyristyl ammonium chloride and the corresponding bromides or chlorides.

Although the non-built detergent compositions intended for light duty uses, such as dishwashing, sterilization, fabric softening and cleaning of delicate materials, may be made without builder salts, normally such salts are incorporated in pre-soak compositions, heavy duty detergent products, denture cleansers and scouring powders. Preferable builder salts are the alkali metal salts, more preferably the sodium and potassium salts of inorganic acids, e.g., borax, pentasodium tripolyphosphate, tetrasodium pyrophosphate (borax and phosphates may be omitted for ecological reasons), sodium silicates, generally of $Na_2O:SiO_2$ ratios of 1:1.6 to 1:2.6, e.g., 1:2.4, sodium carbonate and potassium bicarbonate. Inorganic builders are preferred but organic builders are also useful, e.g., trisodium nitrilotriacetate, sodium citrate, potassium gluconate, and hydroxyethyl iminodiacetate, disodium salt. With the builder salts there may often be employed filler salts, such as alkali metal halides and sulfates, e.g., sodium chloride, sodium sulfate.

Builders and fillers may also be parts of bleaching compositions, in which detergents are either not present or are present in small quantity, e.g., less than 3%.

In the detergent compositions there may also be present enzymes for assisting in breaking down the molecular structures of various stains and thereby helping to remove them from the substrates to which they are attached. Such enzymes are usually proteolytic enzymes, e.g., protease (sold under the trademark Alcalase®) but also useful are amylotic and other enzymes, e.g., amylase. Various other components may be present in the detergent and bleaching compositions including soil suspending agents, anti-redeposition agents, hydrotropes, wetting agents, flow-improving agents, sequestrants, bactericides, fluoroscent brighteners, stabilizers, fillers, fungicides, emollients, perfumes, colorants and solvents. The higher fatty acid stabilizers, which may act to some extent as coating agents, in addition to stabilizing percompounds and percompound-activator(s) mixtures, will also assist in stabilizing other materials in the composition which are normally deteriorated in storage due to exposure to moisture or air, such as enzyme components, fluorescent brighteners and bactericides.

More extensive descriptions of the various ingredients of the present detergent compositions and other preparations including the activated bleach compositions of this invention are found in U.S. Pat. Nos. 3,637,339; 3,640,874; 3,655,567; and 3,714,050, the disclosures of which are incorporated herein by reference. Also included by reference are the descriptions of the various synthetic organic detergents, enzymes, adjuvants, bleaches and activators described in those patents and the proportions mentioned and conditions under which such materials are employed, together with methods for manufacturing them and components thereof.

Additional descriptions of the detergents that are useful and accompanying builders, adjuvants, etc., are found in the texts *Surface Active Agents and Detergents,* Vol. II, by Schwartz, Perry and Berch, published in 1958 by Interscience Publishers, Inc., especially at pages 25–138, and in *Detergents and Emulsifiers,* 1969 Annual, by John W. McCutcheon.

The proportions of the various components of the various bleaching compositions will normally be in the range of 1:0.1 to 1.5:0.1 to 3:0.1 to 3 for the percompound(s), activator(s), molecular sieve zeolite(s) and higher fatty acid(s), respectively, with such ratios preferably being 1:0.2 to 1:0.15 to 1:0.5 to 1, respectively. Percentagewise, the proportions of the components, given in the same order, are 25 to 60%, 5 to 35%, 5 to 25% and 10 to 40% and more preferably, 30 to 50%, 8 to 30%, 8 to 20% and 15 to 35%, respectively. Such percentages may be diminished proportionately when other components are present in the compositions, such as the adjuvants previously mentioned, builder salts, filler salts, and active detersive materials. When mixtures of activators are employed (mixtures of each type may also be used) the proportions thereof will normally be in the range of 1:4 to 4:1, more preferably 1:2 to 2:1 and most preferably about 1:1. However, in various preferred embodiments of the invention the triazine type activator will often be present alone (without acyl activator).

In many bleach compositions alkaline metal salts, such as builder salts, many of which have been previously described, will be employed to adjust the pH to a desirable range, e.g., 8.5 to 10.5, preferably 9 to 10. Such materials will usually be present in the composition to the extent of 5 to 50%, preferably 5 to 35%, and will usually be alkali metal salts. For ecological reasons it is often desirable for phosphates to be omitted from the present bleach compositions although where no eutrophication problems or legal restrictions exist they may be employed. Where phosphorus-containing compounds are omitted from the bleach it may be desirable to have present from 5 to 25% of alkali metal carbonate, such as sodium carbonate, often with 1 to 15% of sodium silicate, e.g., about 5 to 10% of sodium silicate, the $Na_2O:SiO_2$ ratio of which will be about 1:2 to 2.6, preferably 1:2.2 to 2.5 and most preferably, about 1:2.35. In addition to the builder salts, filler salts, such as sodium sulfate and sodium chloride, may also be present, preferably in a percentage within the range of 5 to 50%, preferably 10 to 40%.

The various adjuvants present will normally total about 1 to 10%, with the individual adjuvants generally being within the range of 0.01 to 5%. The percentage of soil suspending agent, such as sodium carboxymethyl cellulose, may be from 0.5 to 2% while that of fluoroescent brighteners or optical dyes may range from 0.01 to 2%. Of course, when any component is used in predominant proportion the percentages of other components of the product will be diminished accordingly. The percentage ranges given hereinabove for percompounds, activators, zeolites, builders, fillers and adjuvants also may apply to the bleach compositions (in which detergent is omitted or is present in very small percentage).

In another embodiment of the invention, a bleaching detergent composition, which includes a synthetic organic detergent, such as previously described, the bleaching composition components of the invention are the same and in addition there is present a synthetic organic detergent or synthetic organic detergent mixture, normally in a proportion with respect to one part of the percompound, of 0.1 to 2, preferably 0.2 to 1, which will normally constitute from 2 to 40%, preferably 5 to 30% of the bleaching detergent composition. In such composition preferred proportions of the "bleaching composition" components mentioned will be 10 to 30%, 2 to 20%, 2 to 15%, 5 to 20% and 2 to 30%, respectively. When builder salts, filler salts, fluorescent brighteners, enzymes and various other adjuvants are also present the percentages thereof will be those previously mentioned for bleaching compositions and the percentages of the five main components, as mentioned immediately above, will be diminished accordingly.

In the manufacture of the present stabilized activated bleaches and bleaching detergents various conventional methods may be used, except for the mechanical mixing of the powdered myristic acid or other higher fatty acid composition with the perborate plus activator(s) at room temperature, which is considered to be "unconventional". The various powdered components of the bleaching and bleaching detergent compositions will normally be of particle sizes in the 0.5 micron to 2.5 mm. diameter range, with the smallest components being the molecular sieve zeolite particles and the largest components being detergent particles, usually in spray dried form with builder and filler salts (possibly with some zeolite in the spray dried product). Thus, the molecular sieve zeolites will usually be of particle diameters of at least 0.5 micron, normally from 0.5 to about 12 microns and preferably of at least 5 microns, e.g., 5 to 9 microns. The spray dried, granulated, agglomerated, roll dried or other type of detergent particle will usually be between 100 microns and 2.5 mm. in diameter, e.g., between No. 8 and No. 140 sieves, preferably between No. 10 and No. 100 sieves, U.S. Standard Sieve Series. The other powdered components, including the perborate or other percompound, the activator(s), the higher fatty acid and any adjuvants not included in particles containing the detergent component, will normally be of particle sizes in the 37 to 250 microns diameter range, preferably of 44 to 149 microns. Alternatively, the detergent, adjuvant, builder and filler may also be of particle sizes in such ranges but it is preferred that they be of the larger sizes mentioned and that the detergent and accompanying materials be in spray dried form. Of course, when the compositions made are not bleaching detergents and contain no substantial quantity of synthetic organic detergent (having an upper limit of about 5%, preferably about 3%) it will be usual for them (except for the molecular sieve zeolite) to be of the intermediate particle sizes previously mentioned, 37 to 250 microns, preferably 44 to 149 microns.

The mechanical mixing method employed may be any suitable such method in which the higher fatty acid is so distributed with respect to the percompound and activator(s) as to stabilize the mixture during storage and to promote more effective bleaching in use thereof. Such mixing is preferably conducted at room temperature, normally in the range of 5° to 35° C., preferably from 10° to 30° C. and most preferably about 20° to 25°0 C., although sometimes the actual temperature of some of the materials being mixed may rise to as high as 50° C., due to internal friction, as during milling processes. Nevertheless, it is preferred to maintain the temperature in the lower ranges mentioned. The mixing apparatuses utilized may be any conventional mixers or mills, e.g., Day mixers, tumbling drums, twin-shell blenders, Lodige mixers, soap mills, etc., and size reducing and classification equipment may also be utilized for its mixing functions, e.g., screens, micropulverizers. However, with respect to operations in which the higher fatty acid is mixed or blended with the other bleach or bleaching detergent components, a tumbling mixing, as in an inclined drum rotating at about 5 to 60 revolutions per minute, is preferred. The mixing or blending equipment employed may be cooled so as to maintain the temperature of the material being processed in the room temperature ranges previously recited. Preferably, the materials being mixed are maintained at about 20° to 25° C.

The times of mixing may vary from about one minute to one hour but usually are from 5 to 50 minutes. Although the various components of the bleaching and bleaching detergent compositions may be mixed together all at one time it is preferred to effect the mixing sequentially, with the percompound and activator being initially mixed together over a period of about one to ten minutes, e.g., 2 to 5 minutes, after which said mixture is admixed with powdered higher fatty acid over a period of about 1 to 10 minutes, e.g., 2 to 5 minutes, followed by further mixing with molecular sieve zeolite over a period of about 2 to 20 minutes, e.g., 3 to 10 minutes. Subsequently, the product made may be admixed with various other builder, filler, adjuvant, detergent and other materials for a suitable period of time, e.g., 1 to 10 minutes, to produce a final product. Prior to the final mixing the pre-mixes may be screened, size reduced or otherwise converted to desirable powder form and if desired, after the final mixing, screening and particle size classification may also be undertaken. Normally, the times of mixings of the percompound-activator mixture with higher fatty acid and such product with molecular sieve zeolite will be such as allow the satisfactory distribution of the higher fatty acid over the surfaces of the percompound and activator particles and permit the molecular sieve zeolite to be held to the fatty acid to prevent any objectionable dusting. In an alternative manufacturing method the percompound and activator may be separately pre-mixed with portions of the higher fatty acid content and may be subsequently mixed with the molecular sieve zeolite. However, the previously described method is preferred.

As is evident from the description of the method of manufacture of the present compositions, no special equipment is required because the temperature of the higher fatty acid does not have to be raised so as to liquefy and spray it and accordingly, the percompound and activator are not raised in temperature, which could cause premature decomposition of the percompound and loss of activity. Also, agglomeration due to such spraying may be avoided or controlled by the present method and even if it is necessary to size reduce the product after mixing, the size reduction is such that the surfaces exposed are usually still coated with higher fatty acid, rather than uncoated percompound and activator, which can be the case when size reduction is effected after spray coating of particles with the fatty acid.

By the preferred method of this invention a product is made which has the activator and percompound located close together so as to facilitate reaction thereof when the product is intentionally put in a liquid medium and yet the fatty acid, probably in the form of a coating over the percompound and activator particles, inhibits access to the particles by moisture in the air, thereby preventing premature decomposition. An additional desirable feature of the present invention is in the molecular sieve zeolite coating the higher fatty acid and thereby acting as a preliminary barrier to moisture, since it can be further hydrated over its normally anhydrous or possibly partially hydrated state. Similarly, the higher fatty acid holds the finely divided zeolite powder and prevents it from dusting objectionably. Of course, the zeolite has water softening capabilities and tends to prevent reaction of water hardness with the fatty acid, which might otherwise produce objectionable insoluble soaps. A further advantage of the invention is in the maintenance of the percompound and activator insulated by the higher fatty acid and zeolite from contact with materials such as enzymes, fluorescent brighteners, detergents and other adjuvant materials which could be adversely affected by oxidizing conditions producible by the percompound-activator combination. For example, the stain reducing activities of proteolytic enzymes, such as protease, and other enzymes, e.g., lipases, amylase can be improved by the presence of the higher fatty acid of the present invention, as can be the stability of fluorescent brightening compounds such as the various cotton brighteners, polyamide brighteners and polyester brighteners, which may be reaction products of cyanuric chloride and the disodium salt of diaminostilbene disulfonic acid, benzidine sulfone disulfonic acid, aminocoumarins, diphenyl pyrazoline derivatives or naphthotriazolyl stilbenes, such as, for example, those sold under the names of Calcofluor ®, Tinopal ® RBS and 5BM and Phorwite® BHC. Such materials are described in the article *Optical Brighteners and Their Evaluation* by Per S. Stensby, a reprint of articles published in *Soap and Chemical Specialties* in April, May, July, August and September, 1967, especially at pages 3–5 thereof, incorporated herein by reference.

The bleaching and washing methods of this invention may be carried out at various pH's and concentrations but normally the pH will be in the range of 8 to 12, preferably 8.5 to 10.5 and most preferably it will be about 9 to 10. The concentration of invented bleaching composition in aqueous medium, such as water, will normally be from 0.01 to 0.2% and preferably will be 0.02 to 0.1% whereas when the bleaching composition is part of a detergent composition (usually being from 20 to 60% thereof, preferably 20 to 40% thereof), the total bleaching detergent composition concentration in the wash water will normally be from 0.05 to 2%, preferably being about 0.1 to 1%. Most preferably, such concentration will be about 0.15% in the United States and about 0.8% in European countries wherein high concentrations of detergent and low volumes of wash water have been employed in the conventional washing machines. Usually the laundry : wash water ratio will be from 0.03 to 0.2, preferably 0.04 to 0.1, e.g., 0.05 or 0.06 for United States laundering practices and about 1 to 5 times these ratios, e.g., 3 times, for European practices.

The present compositions are employed in the same manner as comparable products not containing the bleaching components. Thus, they may be used for cold, warm and hot water washing, usually in the temperature range of 10° to 70° C. Of course, as with all bleaching operations, care should be taken in the selection of materials to be bleached but apart from this general precaution, the present compositions may be employed with safety, giving effective bleaching, even with colored goods, without seriously adversely affecting dye fastness. Excellent cold and warm water bleachings are obtainable, comparable to those from utilizations of the same proportions of peroxy compounds, such as sodium perborate, at or near the boil. When employing detergents, the washing times need not be changed from ordinary wash cycle times, usually being from 3 to 45 minutes, preferably being from 5 to 20 minutes in the United States and from 20 to 40 minutes according to European practice. Similar or corresponding times may also be employed with respect to other applications of the bleaching compositions, such as those previously mentioned, or the corresponding application times normally utilized for such products may be employed, e.g., 5 minutes to 3 hours for bleaching applications.

As a result of using the compositions and processes of this invention improved stabilities of the bleach and bleaching detergent compositions are obtained on storage and improved bleaching effects and combination washing-bleaching effects are obtained without the need to raise the aqueous medium employed to its boiling point. Also, any fugitive dyes not bleached by the oxidizing agent tend to be adsorbed by the ultrafine zeolite molecular sieve particles and thereby do not selectively deposit on fabrics being washed, changing their colors.

The activated bleaching composition and detergent-bleaches are especially good for removing or helping to remove a wide variety of difficult to remove stains from fabrics, including coffee, tea, wine and dye stains. Such desirable results are obtained without harming the fabrics being treated and without serious adverse effects on dyed fabrics, such as blue dyed polyester-cotton blends, which are often used as test fabrics to determine the safeness of bleaches. Such safe bleaching results are especially noted with the bleaching and bleaching-detergent compositions containing mixtures of activators of both the triazine and acyl types. Additionally, the oxygen releasing percompounds of this invention also possess desirable antimicrobial properties and such properties are aided by the presences of the activator(s), molecular sieve zeolite and detergent components of the invented products. The detergent helps to wet the various surfaces to be treated with the bleach combination (percompound plus activators) and the molecular sieve zeolite furnishes nuclei for percompound decomposition in aqueous media (while when the product is in powder form it helps to insulate and stabilize the bleaching compound mixture against decomposition) and also may adsorb or entrap in its crystalline or amorphous matrix viral and bacterial substances, assisting in the antimicrobial effects of the oxygen-releasing compounds, which may release oxygen at such nuclei. Thus, there is significant coaction between the various components of the bleaching and bleaching detergent compositions of this invention.

The invention will be further illustrated by the following examples. Unless otherwise indicated, all parts therein and in the specification are by weight and all temperatures are in ° C.

EXAMPLE 1

Forty parts of sodium perborate tetrahydrate and twenty parts of BHADT activator are mixed together for five minutes in a Day mixer rotating at 50 revolutions per minute. The materials charged are initially powders of average diameters in the 44 to 149 micron range, being about 100 microns. After the pre-mixing of the percompound and activator thirty parts of powdered myristic acid of the same particle size are added and the tumbling mixing is continued for another five minutes, after which ten parts of anhydrous molecular sieve zeolite type 4A, (of a moisture content of about 2%) are admixed and mixing is continued for another ten minutes, at which time the mixture no longer gives off any zeolite dust. During the entire operation the temperature of the product is maintained in the range of 20° to 30° C.

The product resulting is aged for six months at room temperature in a barrier-type carton and after that time is analyzed for active oxygen content. Although there has been some loss in active oxygen the product is still usable and satisfactory as a bleach after such storage. Also, it is free of any chlorine or halogen odor which is sometimes noted when blends of percompound and activator are made without higher fatty acid treatment in accordance with this invention.

Without lengthy aging, the recently manufactured product of this invention of the formula described above is tested for its bleaching ability against various standard soiled fabrics and is found to be effective against coffee/tea, wine and sulfo dye stains, non-discoloring of white goods (cotton) and not to objectionably discolor blue percale.

In the manufacture of a bleaching detergent, a preferred form of the present invention, thirty parts of a spray dried commercial detergent, having particle sizes between No's. 8 and 100 meshes, are tumbled with 25 parts of the previously described blend of sodium perborate tetrahydrate, BHADT, powdered myristic acid and molecular sieve zeolite type 4A at room temperature, 25° C., for five minutes. The commercial detergent is of the formula: sodium linear tridecylbenzene sulfonate (9%); $C_{14-15}$ higher alkanol polyethoxy (11 ethoxies) ethanol (4%, post-added); pentasodium tripolyphosphate (33.6% or 18.4% as $P_2O_5$); sodium silicate (7%, $Na_2O:SiO_2$ = 1:2.4); sodium carboxymethyl cellulose (0.5%); fluorescent brighteners (0.85% of a mixture of Tinopal RBS 200 and Tinopal 5BM Conc.); sodium sulfate (34.8%); moisture (10%); and small proportions, less than 0.5% of dye, perfume and stabilizer. The product made is free flowing, dust-free and stable on storage for lengthy periods of time in barrier cartons and exhibits no halogen odor when the cartons are opened. It is also stable when aged ten days at 43° C. and at 80% relative humidity.

Freshly made bleaching detergent of the formula described above and made by such process is tested against coffee/tea stain swatches, EMPA 114 (wine) stain swatches (Testfabrics, Inc.), EMPA 115 immedial black swatches or sulfo dye swatches (Testfabrics, Inc.), white cotton swatches (6 cm. by 6 cm., 32 threads per millimeter by 32 threads per millimeter) and blue percale swatches (Burlington House) by washing in a laboratory tergotometer washing machine turning at 100 revolutions per minute for 15 minutes in one liter of wash water at 49° C., using 2.8 grams of the bleaching detergent composition. Final wash pH is 9.2. The mixed load of swatches is rinsed and dried, ΔRd reflectance values (Gardner Color Difference Meter) are read and ΔRd's are calculated.

In a similar manner there is tested a "control" composition in which, instead of powdered myristic acid being blended with the pre-mix of sodium perborate and BHADT, the myristic acid is melted and sprayed onto a mechanical mixture of the perborate and BHADT to coat the particles thereof. During such manufacture a halogen odor is detected and such control products also have a halogen odor after storage. Also employed is the detergent alone, without percompound, activator and myristic acid. The following table gives the results of the various washing and bleaching-washing operations.

TABLE I

| | Coffee/Tea | wine | Black Dye | White Cotton | Blue Percale | |
|---|---|---|---|---|---|---|
| Product | ΔRd | ΔRd | ΔRd | ΔRd | ΔRd | Δb |
| Detergent | −1.5 | +8.2 | −0.1 | −0.8 | +1.1 | +1.9 |
| Invented blend (fresh)* | +8.3 | +23.1 | +28.7 | +0.3 | +1.6 | +0.4 |
| Invented Invented blend (aged)** | +8.4 | +24.7 | +25.7 | +0.2 | +1.2 | +0.3 |
| Control blend (fresh)* | +8.4 | +24.0 | +29.4 | +0.2 | +1.0 | +1.0 |
| Control (aged)** | +8.0 | +24.4 | +25.8 | +0.1 | +0.5 | +0.5 |

*Freshly prepared.
**Aged ten days at 43° C. and at 80% relative humidity.

It can be seen from the above results that the product of this invention, made by the cheaper, easier, energy conserving manufacturing process of this invention, is far superior in bleaching power to a commercial detergent employed alone and after storage appears to lose less of its initial active oxygen bleaching ability than does the control, made by spraying myristic acid onto the surfaces of a mixture of perborate and activator particles. Despite its good bleaching effect it appears that the invented composition and process result in less damage to blue percale during bleaching and washing, signified by lower Δ*b* readings.

In modifications of the formulation of the bleaching detergent in one case the nonionic detergent is omitted and in another case sodium coco-tallow soap (hydrogenated coconut oil: hydrogenated tallow ratio of 1:4) is employed to the extent of 1% in the formula (replacing that amount of sodium sulfate) to assist in diminishing foaming tendencies. Such products also exhibit the desirable bleaching activities mentioned. Similarly, when the pentasodium tripolyphosphate is replaced by approximately equal parts of sodium silicate ($Na_2O:SiO_2$ = 1:2.4), sodium carbonate and sodium sulfate, a good bleaching detergent is produced. Such desirable bleaching effects are also obtained when, to the bleach composition,. comprising percompound, activator, molecular sieve zeolite and powdered myristic acid, there is added a mixture of sodium sulfate and pentasodium tripolyphosphate, so that the proportions thereof in the product are about 20% each.

Good bleaches and bleaching detergents are also produced when instead of the BHADT activator there are substituted DCT, DDG or TAG activators or mixtures thereof, in similar proportions.

When proportions of the various components of the foregoing examples are varied ±10%, ±20% and ±30%, while still being within the ranges of ratios and percentages given in the specification, good stable activated bleaches and bleaching detergents are also produced. While it is preferred that in all such experiments ahydrous molecular sieve zeolite should be employed, when utilizing partially hydrated molecular sieve zeolites, e.g., those of 10 to 15% moisture content, acceptable products are made, although they appear to be somewhat less stable on storage, probably due to the additional content of moisture in the molecular sieve zeolite.

EXAMPLE 2

The experiments of Example 1 are carried out but with the use of sodium carbonate peroxide in one instance and sodium percarbonate in another. Essentially the same bleaching and bleaching-detergent actions result, with the myristic acid effectively stabilizing the percompound-activator mixtures. When the variations of Example 1 are applied to the compositions of this example similar results are also obtained.

EXAMPLE 3

In place of type 4A molecular sieve zeolite (Henkel & Cie.) such a zeolite manufactured by Union Carbide is employed in the compositions of the previous examples and equivalent results are obtained. Similarly, in place of the type 4A molecular sieve zeolite, when other type A molecular sieve zeolites and those of types X, Y and L are utilized good bleaches and detergents are produced. This is also the case when the pore sizes are 4 Angstroms in diameter and when they are of other diameters from 3 to 10 Angstroms and mixtures thereof. In most such cases the preferred compositions and processes are those incorporating and/or utilizing anhydrous molecular sieve zeolites, such as those containing less than 3% of moisture but useful products are also made from partially hydrated molecular sieve zeolites (often of up to 15% moisture).

EXAMPLE 4

The procedures of Examples 1–3 are repeated, utilizing lauric acid and palmitic acid in separate experiments and a mixture of the two saturated fatty acids in equal parts in a third experiment, in place of myristic acid. While these other fatty acids also usefully stabilize the various bleaches and bleaching detergents and the products successfully bleach cotton, cotton-polyester blends, permanent press fabrics and other materials, in cold, warm and hot waters, it appears that processing is easier with myristic acid and the products made are more stable. Accordingly, use of myristic acid in powdered form is highly preferred.

In variations of this example and the previous examples bleaching solution and wash water temperatures are varied over the range described in the specification and the proportions of bleach and bleaching detergent employed are varied within the given ranges and acceptable bleaching and combination washing and bleaching are obtainable.

EXAMPLE 5

Examples 1–4 are repeated but the spray dried detergent particles are subsequently size reduced (before blending with the bleach components) to about the same particle sizes as the bleach components. The product made, while not as free flowing as the products based on spray dried detergent beads, and with a tendency to be somewhat dustier, is a useful bleaching detergent of properties like those of the compositions previously described.

The invention has been described with respect to various illustrations and embodiments thereof but is not to be limited to these because it is evident that one of skill in the art, with the present specification before him, will be able to utilize substitutes and equivalents without departing from the spirit of the invention.

What is claimed is:

1. A stabilized activated percompound bleaching composition in particulate form comprising, by weight, a mechanical mixture of one part of a bleaching percompound selected from the group consisting of inorganic percompounds and urea peroxide, 0.1 to 1.5 parts of an organic activator for such percompound which, in aqueous bleaching solution, activates the percompound to promote bleaching by it and is selected from the group consisting of hydroperoxide-forming triazine activators, peracid generating acyl activators and mixtures thereof, 0.1 to 3 parts of a molecular sieve zeolite selected from the group consisting of Types A, X and Y synthetic molecular sieve zeolites having the capacity to sequester calcium ions, a water content of from 0.5% to 36% by weight and a particle size of 0.5 to 12 microns, and 0.1 to 3 parts of a $C_{10}$–$C_{18}$ fatty acid, said fatty acid being in powder form and the particles of said composition having a diameter of from 0.5 microns to 2.5 millimeters.

2. A bleaching composition according to claim 1 which includes, in addition, 5% to 50% by weight of alkali metal inorganic and organic builder salts.

3. A bleaching composition according to claim 1 wherein the proportions of the components are 25 to 60% of sodium perborate tetrahydrate, 5 to 35% of 2-[bis(2-hydroxyethyl)-amino]-4,6-dichloro-s-triazine, 5 to 25% of type 4A anhydrous synthetic molecular sieve zeolite and 10 to 40% of myristic acid.

4. A bleaching composition according to claim 1 wherein the percompound is selected from the group consisting of sodium perborate and sodium percarbonate and the activator is selected from the group consisting of 2-[di-(2-hydroxy-$C_1$–$C_5$ alkyl)amino]-4,6-dihalo-s-triazine, 2,4-di-$C_1$–$C_4$ alkoxy-6-halo-s-triazine, di-$C_2$–$C_5$-alkanoyl di-$C_1$–$C_4$ alkyl glyoxime, tetra-$C_2$–$C_5$ alkanoyl glycoluril and mixtures thereof.

5. A bleaching composition according to claim 4 wherein the percompound is sodium perborate tetrahydrate, the activator is 2-[bis(2-hydroxyethyl)amino]-4,6-dichloro-s-triazine, the synthetic molecular sieve zeolite is a type A synthetic molecular sieve zeolite of 0.5% to 3% mositure content and the higher fatty acid is myristic acid.

6. A method of bleaching fibrous organic materials which comprises contacting them with an aqueous medium containing the bleaching composition of claim 1.

7. A method according to claim 6 wherein the aqueous medium is water, the bleaching composition is added to the water as a powder mixture and bleaching is effected at a temperature in the range of 10° to 60° C. at a concentration in the water of 0.05 to 0.5% of the bleaching composition.

8. A method of manufacturing the stabilized activated percompound bleaching composition of claim 1 comprising mechanically mixing the powdered fatty acid with at least one of the group of components consisting of bleaching percompound and the activator for the bleaching compound before admixing the mixture thereof with said other component and thereafter admixing the resultant mixture with the molecular sieve zeolites, each of said components being in powdered form with an initial particle diameter in the range of 0.5 to 250 microns.

9. A method according to claim 8 wherein the mixing thereof is effected at about room temperature.

10. A method according to claim 9 wherein the components of the activated percompound bleaching composition are initially of particle sizes in the range of 5 to 149 microns in diameter, the percompound is sodium perborate tetrahydrate, the activator is 2-[bis(2-hydroxyethyl)amino]-4,6-dichloro-s-triazine, the synthetic molecular sieve zeolite is a type A zeolite of 0.5% to 3% moisture content and the higher fatty acid is myristic acid, the proportions are 25 to 60%, 5 to 35%, 5 to 25% and 10 to 40%, respectively and admixing is effected by blending the sodium perborate tetrahydrate and activator together for a period from 1 to 10 minutes, then admixing with the perborate-activator blend all the powdered myristic acid, continuing mixing for an additional 1 to 10 minutes and subsequently admixing with the perborate-activator-myristic acid mixture the molecular sieve zeolite and mixing for an additional 2 to 20 minutes.

11. A stabilized activated percompound bleaching composition according to claim 1 which includes, in addition, 0.1 to 2 parts of a water-soluble synthetic organic detergent.

12. A bleaching detergent composition according to claim 11 in which the percompound is selected from the group consisting of sodium perborate and sodium percarbonate, the activator is selected from the group consisting of 2-[di-(2-hydroxy-$C_1$-$C_5$ alkyl)amino]-4,6-dihalo-s-triazine, 2,4-di-$C_1$-$C_4$ alkoxy-6-halo-s-triazine, di-$C_2$-$C_5$ alkanoyl di-$C_1$-$C_4$ alkyl glyoxime, tetra $C_2$-$C_5$ alkanoyl glycoluril and mixtures thereof the higher fatty acid is of 12 to 16 carbon atoms and said composition includes a synthetic organic detergent selected from the group consisting of anionic acid nonionic detergents and mixtures thereof.

13. A bleaching detergent composition according to claim 11 which includes, in addition, 5% to 50% by weight of alkali metal inorganic and organic builder salts.

14. A method of washing and bleaching fibrous organic materials which comprises contacting them with water containing the bleaching detergent composition of claim 13, the washing and bleaching being effected at a temperature in the range of 10° to 60° C. at a concentration in water of 0.1 to 1% of said bleaching detergent composition.

15. A method according to claim 14 wherein the bleaching detergent composition is that of claim 18.

16. A bleaching detergent composition according to claim 11 wherein the percompound is sodium perborate tetrahydrate, the activator is 2-[bis(2-hydroxyethyl-)amino]-4,6-dichloro-s-triazine, the synthetic molecular sieve zeolite is a type A synthetic molecular sieve zeolite of 0.5% to 3% moisture content, the higher fatty acid is myristic acid and the synthetic organic detergent includes sodium linear $C_{10}$–$C_{18}$ alkylbenzene sulfonate.

17. A bleaching detergent composition according to claim 16 wherein each of the percompound, activator, synthetic molecular sieve zeolite and myristic acid components of the bleaching detergent composition is in powdered form, with particle sizes in the range of 0.5 to 250 microns in diameter, the molecular sieve zeolite is of type 4A, the higher linear alkyl of the higher linear alkylbenzene sulfonate is of 12 to 14 carbon atoms, and the proportions, by weight of said components are 10 to 30%, 2 to 20%, 2 to 15%, 5 to 20% and 2 to 30%, respectively.

18. A bleaching detergent composition according to claim 17 wherein the sodium linear $C_{10}$–$C_{18}$ alkyl benzene sulfonate detergent is present with builder salt in globular particles of diameters in the 250 micron to 2 millimeter range in a sodium higher linear alkylbenzene sulfonate: builder salt ratio of 1 : 2 to 10 and said builder salt is selected from the group consisting of sodium carbonate, sodium silicate, pentasodium tripolyphosphate, tetrasodium pyrophosphate and mixtures thereof.

* * * * *

UNITED STATES PATENT OFFICE

CERTIFICATE OF CORRECTION

Patent No. 4,064,062 Dated December 20, 1977

Inventor(s) Joseph A. Yurko

It is certified that error appears in the above-identified patent and that said Letters Patent are hereby corrected as shown below:

In Column 1, line 19 change:

"compound" to --percompound--

In Column 4, line 57 change:

"emcompass" to --encompass--

In Column 4, line 61 change:

"benzioc" to --benzoic--

In Column 6, line 14 change:

"while" to --which--

UNITED STATES PATENT OFFICE

CERTIFICATE OF CORRECTION

Patent No. 4,064,062 Dated December 20, 1977

Inventor(s) Joseph A. Yurko

It is certified that error appears in the above-identified patent and that said Letters Patent are hereby corrected as shown below:

In Column 11, line 31 change:

"25°O" to --25°--

In Column 19, line 2 change:

"acid" to --and--

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*